US006276906B1

(12) United States Patent
Noguchi

(10) Patent No.: US 6,276,906 B1
(45) Date of Patent: Aug. 21, 2001

(54) SPHERICAL CASING AND ELASTIC SUPPORT FOR A HERMETIC MOTOR COMPRESSOR

(75) Inventor: Kazuhito Noguchi, Chigasaki (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 09/424,039

(22) PCT Filed: May 18, 1998

(86) PCT No.: PCT/JP98/02173

§ 371 Date: Nov. 18, 1999

§ 102(e) Date: Nov. 18, 1999

(87) PCT Pub. No.: WO98/53205

PCT Pub. Date: Nov. 26, 1998

(30) Foreign Application Priority Data

May 21, 1997 (JP) ..... 9-130774

(51) Int. Cl.[7] ..... F04B 17/00
(52) U.S. Cl. ..... 417/363; 417/902
(58) Field of Search ..... 417/363, 902; 248/621

(56) References Cited

U.S. PATENT DOCUMENTS

| | | | | |
|---|---|---|---|---|
| 3,187,995 | | 6/1965 | Kjeldsen . | |
| 4,427,349 | | 1/1984 | Elson | 417/363 |
| 4,478,559 | | 10/1984 | Andrione et al. . | |
| 4,990,067 | * | 2/1991 | Sasano et al. | 417/902 |
| 5,554,015 | | 9/1996 | Dreiman et al. . | |
| 6,171,077 | * | 1/2001 | Calciolari et al. | 417/363 |

FOREIGN PATENT DOCUMENTS

| | | | | |
|---|---|---|---|---|
| 507091 A1 | * | 10/1992 | (EP) | 417/363 |
| 0 521 526 | | 1/1993 | (EP) | 417/363 |
| 0 561 385 | | 9/1993 | (EP) . | |
| 63-061795 | | 3/1988 | (JP) . | |
| 1-47632 | | 10/1989 | (JP) . | |
| 3-107581 A | * | 5/1991 | (JP) | 417/363 |
| 3-225084 A | * | 10/1991 | (JP) | 417/902 |
| 5-10266 | | 1/1993 | (JP) | 417/363 |

* cited by examiner

*Primary Examiner*—Cheryl J. Tyler
(74) *Attorney, Agent, or Firm*—Wenderoth, Lind & Ponack, L.L.P.

(57) ABSTRACT

A hermetic motor compressor includes a generally spherical casing having a generally spherical side wall and a first downwardly curved bottom wall, an integrated structure accommodated in said casing and having a compression section and a drive section integrally formed with each other, and a plurality of supporting units for elastically supporting the integrated structure. A plurality of legs are secured to the first downwardly curved bottom wall, and each of them is of the same shape as the downwardly curved bottom wall.

5 Claims, 4 Drawing Sheets

SPHERICAL CASING AND ELASTIC SUPPORT FOR A HERMETIC MOTOR COMPRESSOR

TECHNICAL FIELD

The present invention relates generally to a hermetic motor compressor for use in a refrigerator or the like and, in particular but not exclusively, to a hermetic motor compressor capable of reducing noise emission.

BACKGROUND ART

Recently, hermetic motor compressors (hereinafter referred to simply as compressors) with reduced vibration and reduced noise emission are demanded. Because conventional refrigerants have a tendency to cause ozone layer damage or global warming, the use of hydrocarbon refrigerants having an ozone damaging coefficient of zero and a global warming coefficient of zero is commenced to protect global environment.

FIG. 6 depicts a conventional compressor as disclosed in Japanese Patent Publication (examined) No. 1-47632, which includes a hermetically sealed casing 1 and an integrated structure 4 accommodated in the casing 1. The integrated structure 4 is made up of a compression section 2 and a drive section 3 integrally formed with each other. The compression section 2 includes a cylinder 5, a piston 6 reciprocally mounted in the cylinder 5, a crankshaft 7 connected to a rotor 3*a* of the drive section 3 for rotation together therewith, and a connecting rod 8 for connecting the piston 6 to the crankshaft 7 to convert rotation of the crankshaft to a reciprocating motion of the piston 6.

The casing 1 has a generally flat bottom wall 1*a* and a generally cylindrical side wall1*b* unitarily formed with each other. A gas inlet tube 10 is welded to the side wall 1*b*, while a plurality of legs 11 are welded or secured to the bottom wall 1*a*. The integrated structure 4 is supported by a stay 12 welded to the inner surface of the side wall 1*b*, while the drive section 3 is electrically connected to a power source (not shown) via a hermetic terminal 13 hermetically welded to the side wall 1*b*.

In the above-described construction, because the bottom wall 1*a* is generally flat, the plurality of legs 11 can be welded thereto with good workability. Also, because the side wall1*b* is generally cylindrical and not spherical, the stay 12 can be welded thereto with good workability.

The casing 1 is, however, low in rigidity due to the generally flat shape of the bottom wall 1*a* and the generally cylindrical shape of the side wall 1*b*. Because of this, the casing 1 oscillates slightly and generates noise, or sound produced during operation of the integrated structure 4 accommodated therein leaks through the generally flat or cylindrical portion, thus increasing the noise.

Particularly, in applications where a hydrocarbon refrigerant such as, for example, isobutane is used for a compression refrigerant, the concentration of circulating refrigerant is reduced during cyclic operation of the compressor at the same condensation and evaporation temperatures as in the operation with the use of a conventional refrigerant (for example, CFCR12, HFCR134a or the like) including fluorine or chlorine. Accordingly, enlargement of the internal volume of the cylinder 5 is required, which in turn causes an increase in unbalanced mass, thus increasing vibration and generating noise.

The present invention has been developed to overcome the above-described disadvantages.

It is accordingly an objective of the present invention to provide a hermetic motor compressor capable of reducing vibration and noise emission even if the unbalanced mass is increased which has been hitherto caused by enlargement of the internal volume of the cylinder.

DISCLOSURE OF THE INVENTION

In accomplishing the above and other objectives, the hermetic motor compressor according to the present invention includes a generally spherical casing having a generally spherical side wall and a first downwardly curved bottom wall, an integrated structure accommodated in the casing and having a compression section and a drive section integrally formed with each other, a plurality of supporting units for elastically supporting the integrated structure, and a plurality of legs secured to the first downwardly curved bottom wall and having the same shape as the downwardly curved bottom wall.

This construction is particularly useful when a hydrocarbon refrigerant is used. The reason for this is that the use of the hydrocarbon refrigerant requires enlargement of the internal volume of a cylinder, which in turn causes an increase in unbalanced mass, thus increasing noise. The noise can be considerably reduced by forming the casing into a generally spherical shape having no flat or cylindrical portions, because the generally spherical casing has a high rigidity. In addition, the legs secured to the bottom wall rigidify the casing and reduce noise.

The casing preferably has a second downwardly curved bottom wall having a radius of curvature different from that of the first downwardly curved bottom wall. The two downwardly curved bottom walls having different radii of curvature further rigidify the casing, thus reducing noise.

Advantageously, each of the plurality of supporting units includes a stay of substantially the same shape as the side wall. This stay increases the rigidity of the casing, thus reducing noise.

The stay preferably has a protruding portion integrally formed therewith, a ring-shaped elastic member through which the protruding portion extends, and a stopper mounted on the ring-shaped elastic member, with the protruding portion inserted into the stopper.

Because the ring-shaped elastic member acts as a cushioning member, vibration caused by the compression section and increased with the increase in unbalanced mass is not easily transmitted to the stay via the stopper, thus reducing noise during operation of the compressor.

The casing is generally of two-piece construction having two halves welded together. In this case, it is preferred that the side wall has a radius of curvature smaller than 100% of a radius of curvature of an opening of one of the two halves, while the first downwardly curved bottom wall has a radius of curvature smaller than 120% of the radius of curvature of the opening. It is also preferred that the second downwardly curved bottom wall has a radius of curvature smaller than 35% of the radius of curvature of the opening. The above limitations in radius of curvature are particularly effective in increasing the rigidity of the casing to reduce noise.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on application No. 9-130774 filed May 21, 1997 in Japan, the content of which is incorporated hereinto by reference.

Figure 1:
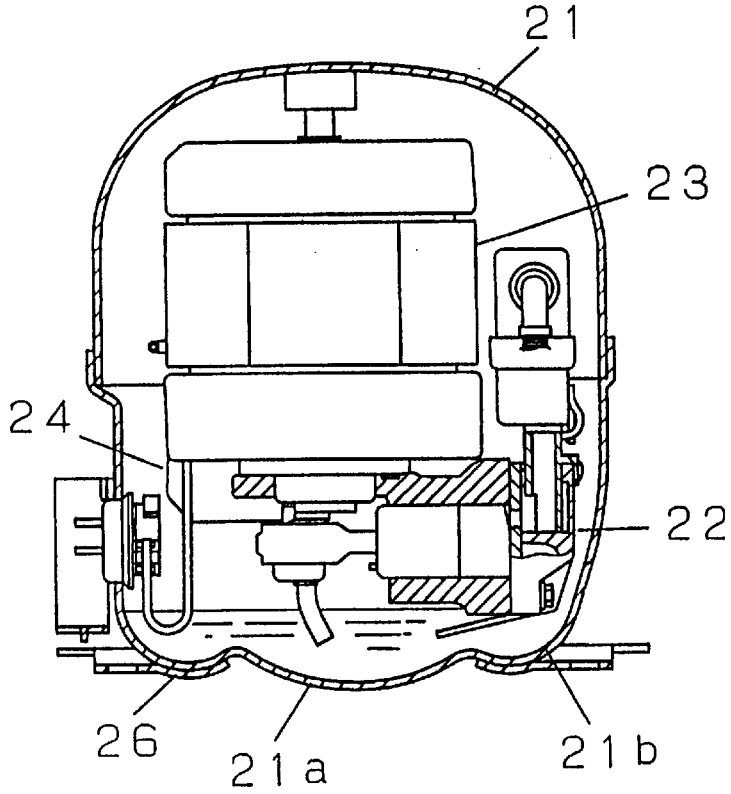
FIG. 1 is a vertical sectional view of a hermetic motor compressor according to the present invention.
Figure 6:
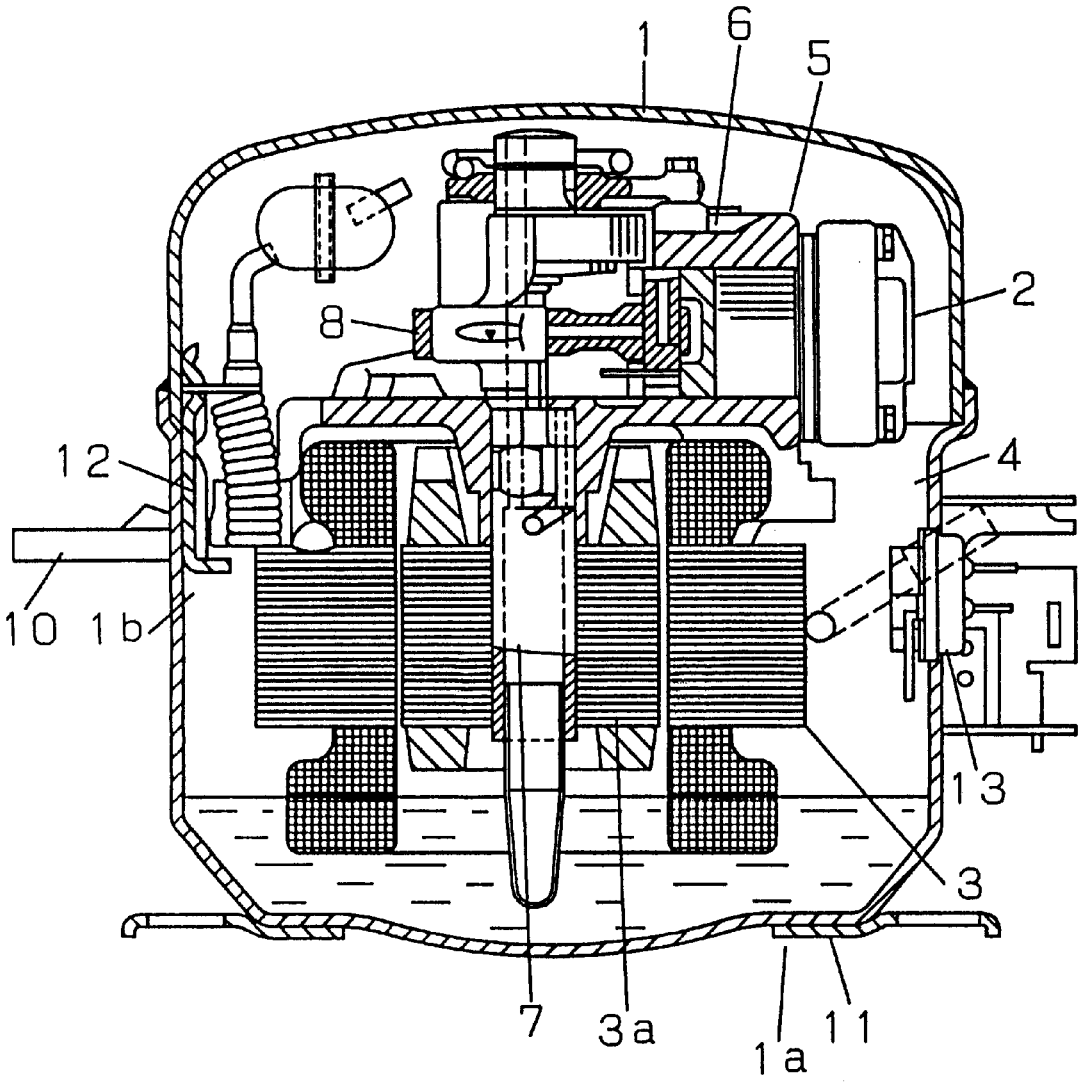
Fig. 6 PRIOR ART
FIG. 6 is a vertical sectional view of a conventional hermetic motor compressor.

Referring now to the drawings, there is shown in FIG. 1 a hermetic motor compressor according to the present invention. As shown therein, the compressor includes a hermetically sealed generally spherical casing 21 and an integrated structure 24 accommodated in the casing 21. The integrated structure 24 is made up of a compression section 22 and a drive section 23 integrally formed with each other. As is the case with the conventional compressor shown in FIG. 6, the compression section 22 includes a cylinder, a piston reciprocally mounted in the cylinder, a crankshaft connected to a rotor of the drive section for rotation together therewith, and a connecting rod for connecting the piston to the crankshaft. The casing 21 has a downwardly curved central bottom wall 21*a* and a downwardly curved annular bottom wall 21*b* formed externally of the central bottom wall 21*a* so as to be continuous thereto. The central bottom wall 21*a* and the annular bottom wall 21*b* have different radii of curvature. As illustrated, each of the central bottom wall 21*a* and the annular bottom wall 21*b* protrudes downwardly and a junction between the central bottom wall 21*a* and annular bottom wall 21*b* is constituted by an upwardly protruding portion protruding upwardly beyond downwardly protruding portions of the central bottom wall 21*a* and the annular bottom wall 21*b*.

The casing 21 has a plurality of legs 26 welded or secured to the annular bottom wall 21*b* and, hence, a portion of each of the plurality of legs 26 is of substantially the same shape as the annular bottom wall 21*b*.

Figure 3:
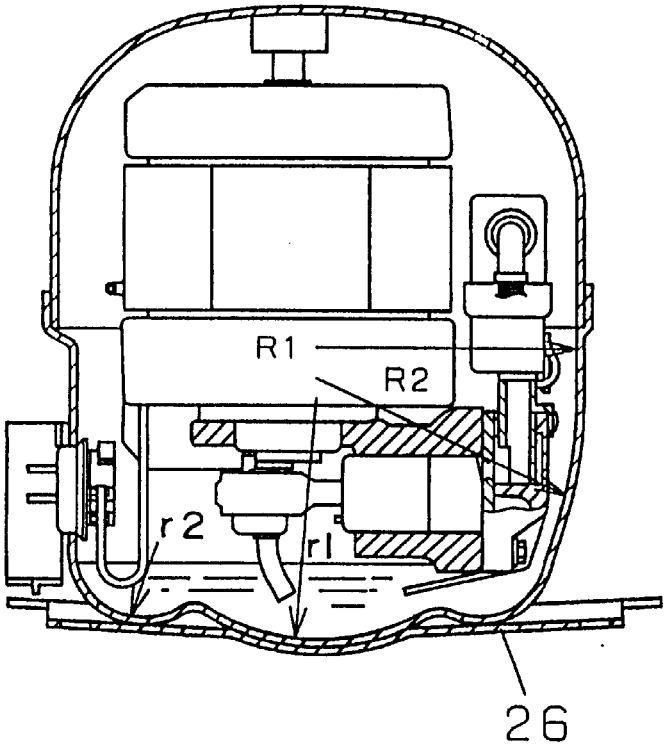
FIG. 3 is a view similar to FIG. 1, particularly showing radii of curvature at various portions of the casing.

Although in the illustrated embodiment the plurality of legs 26 are welded to the annular bottom wall 21*b*, they may be welded to the central bottom wall 21*a*, as shown in FIG. 3.

Figure 2:
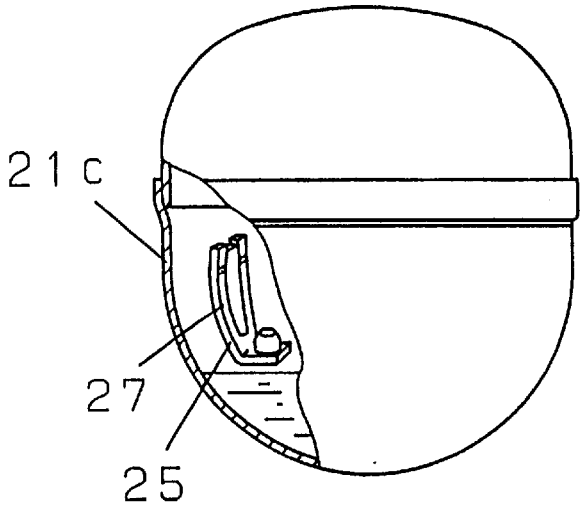
FIG. 2 is a side view of a casing, partly in section, particularly showing one of a plurality of supporting units secured to the casing.

As shown in FIG. 2, the integrated structure 24 is elastically supported by a plurality of supporting units 25 each having a stay 27 welded to a generally spherical side wall 21*c* of the casing 21. To this end, the stay 27 is formed into substantially the same spherical shape as the side wall 21*c* of the casing 21.

If the casing 21 has generally flat portions, sound of 2–3 kHz generated within the integrated structure 24 resonates at such flat portions, thus amplifying the sound. On the other hand, if the casing 21 does not have any flat portions but has a spherical shape, the vibration frequency is in the neighborhood of 4 kHz that differs from the frequency of 2–3kHz referred to above, resulting in a quiet compressor.

According to modal analysis tests made so far by the inventors of the present invention, the casing 21 had the highest rigidity when the casing 21 has the following radii of curvature:

Radius of curvature R2 of the side wall 21*c* as measured in the vertical direction: smaller than 100% of an inlet radius of curvature R1;

Radius of curvature r1 of the central bottom wall 21*a*: smaller than 120% of the inlet radius of curvature R1; and Radius of curvature r2 of the annular bottom wall 21*b*: smaller than 35% of the inlet radius of curvature R1.

It is to be noted that the casing 21 is of two-piece construction having upper and lower halves welded together and that the inlet radius of curvature R1 referred to above is the radius of curvature of an opening of the lower half.

As discussed above, the rigidity of the casing 21 can be increased and noise emission can be considerably reduced by forming the casing 21 into a generally spherical shape in place of a generally flat or cylindrical shape.

Noise tests of the compressor revealed that the noise level of the compressor according to the present invention was 53 dB(A), whereas that of the conventional compressor was 60 dB(A).

It is to be noted that a plurality of laterally outwardly protruding projections having a radius of curvature different from those of the central bottom wall 21*a* and the annular bottom wall 21*b* may be formed with the annular bottom wall 21*b* or the side wall 21*c* to further rigidify the casing 21.

Figure 4:
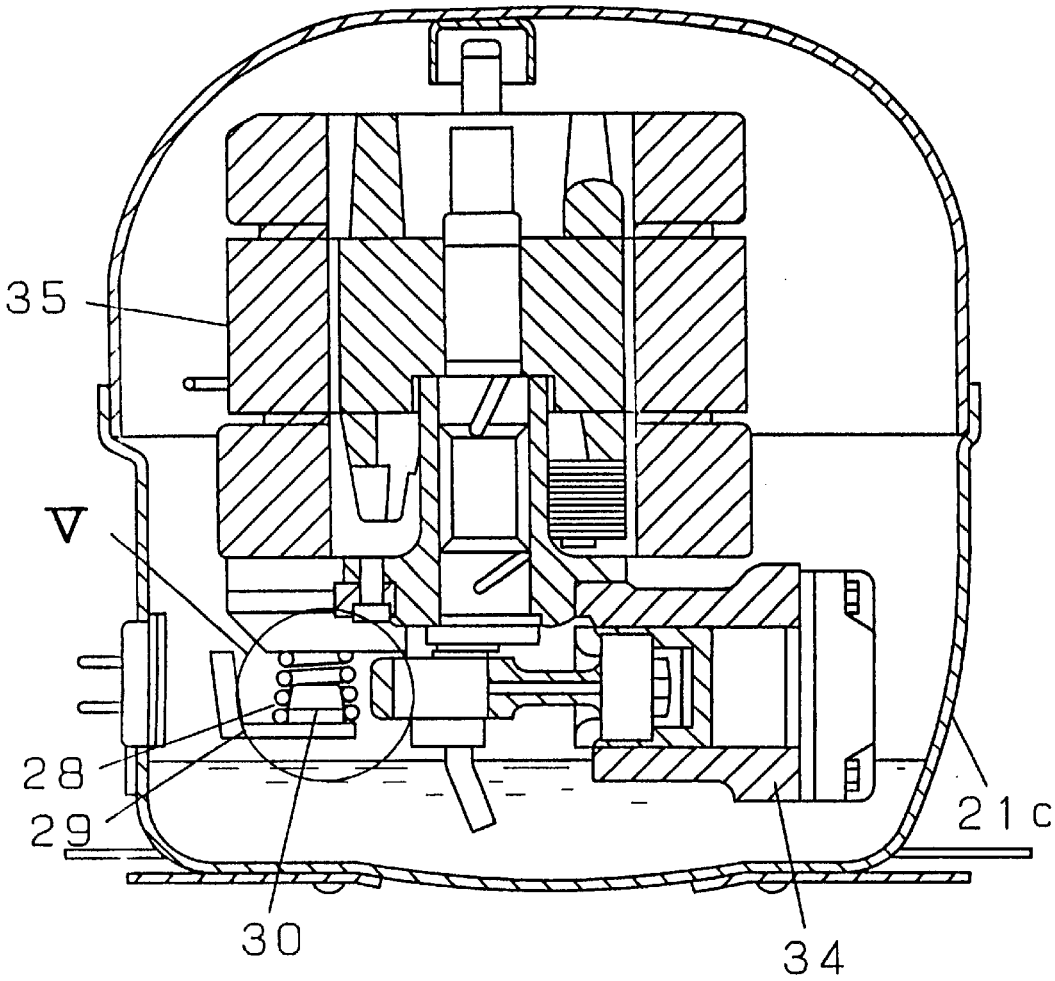
FIG. 4 is a vertical sectional view of another hermetic motor compressor according to the present invention.

A compressor as shown in FIG. 4 includes an integrated structure made up of a compression section 34 and a drive section 35, and a plurality of supporting units for elastically supporting the integrated structure.

Figure 5:
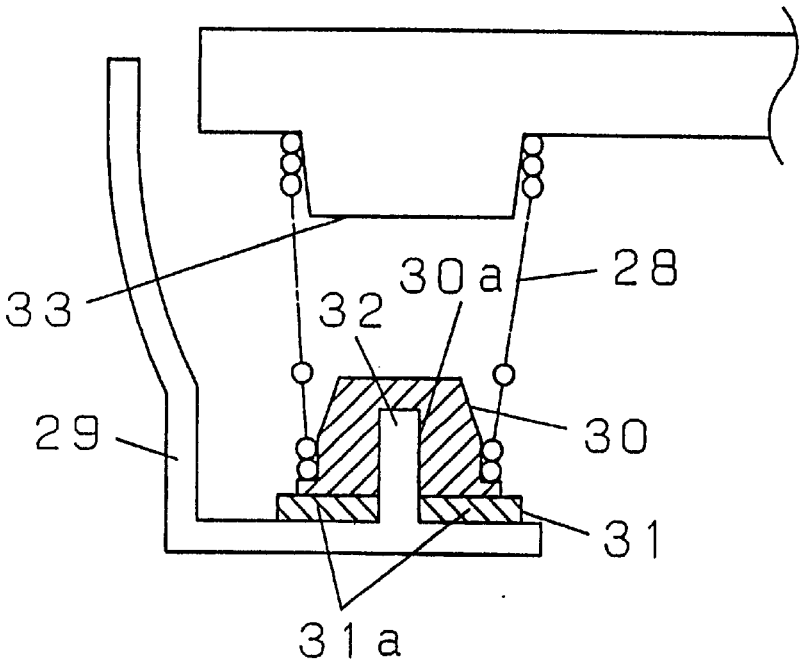
FIG. 5 is an enlarged fragmentary side view, partly in section, of a portion shown by V in FIG. 4.

As shown in FIG. 5, each of the supporting units includes a stay 29 welded to the generally spherical side wall 21*c* of the casing and having an upwardly protruding portion 32 integrally formed therewith. The stay 29 is of substantially the same shape as the generally spherical side wall 21*c*. A ring-shaped elastic member 31 is mounted on the stay 29, and the upwardly protruding portion 32 extends through the ring-shaped elastic member 31. The upwardly protruding portion 32 is also inserted in a hole 30*a* defined in a snubber or stopper 30 so that the snubber 30 may be fixedly mounted on the upper surface 31*a* of the ring-shaped elastic member 31.

A suspension spring 28 is interposed between the compression section 34 and each supporting unit to elastically support the integrated structure. The suspension spring 28 has one end engaged with the snubber 30 and the other end engaged with a snubber or stopper 33 that is formed with the compression section 34.

In the above-described construction, the ring-shaped elastic member 31 acts as a cushioning member for absorbing vibration transmitted from the compression section 34 via the suspension spring 28 and for preventing such vibration from being transmitted to the stay 29 via the upwardly protruding portion 32.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A hermetic motor compressor comprising:

a generally spherical casing having a generally spherical side wall and a first downwardly curved bottom wall;

an integrated structure accommodated in said casing and having a compression section and a drive section integrally formed with each other;

a plurality of supporting units for elastically supporting said integrated structure; and a plurality of legs secured to said first downwardly curved bottom wall and having a same shape as said downwardly curved bottom wall;

wherein each of said plurality of supporting units comprises a stay welded to said side wall and having a protruding portion integrally formed therewith, a ring-shaped elastic member through which said protruding portion extends, and a stopper mounted on said ring-shaped elastic member, said protruding portion being inserted into said stopper.

2. The hermetic motor compressor according to claim 1, wherein each of said plurality of supporting units comprises a stay of substantially a same shape as said side wall.

3. The hermetic motor compressor according to claim 1, wherein said casing is of two-piece construction having two halves welded together and wherein said side wall has a radius of curvature smaller than 100% of a radius of curvature of an opening of one of said two halves, and said first downwardly curved bottom wall has a radius of curvature smaller than 120% of the radius of curvature of said opening.

4. The hermetic motor compressor according to claim 3, wherein said second downwardly curved bottom wall has a radius of curvature small than 35% of the radius of curvature of said opening.

5. The hermetic motor compressor according to claim 1, wherein said casing has a second downwardly curved bottom wall having a radius of curvature different from that of said first downwardly curved bottom wall.

* * * * *